US006029019A

United States Patent [19]

Kawai

[11] Patent Number: 6,029,019

[45] Date of Patent: Feb. 22, 2000

[54] ELECTROPHOTOGRAPHIC IMAGE RECORDING APPARATUS WITH DETECTION OF PROPER INSTALLATION OF PHOTOSENSITIVE DRUM

[75] Inventor: Hideaki Kawai, Kyoto, Japan

[73] Assignee: Murata Kikai Kabushiki Kaisha, Kyoto, Japan

[21] Appl. No.: 09/064,461

[22] Filed: Apr. 22, 1998

[30] Foreign Application Priority Data

Apr. 24, 1997 [JP] Japan ..... 9-121782

[51] Int. Cl.[7] ..... G03G 15/00

[52] U.S. Cl. ..... 399/13; 399/90; 399/117

[58] Field of Search ..... 399/13, 26, 88, 399/90, 116, 117, 159

[56] References Cited

U.S. PATENT DOCUMENTS 4,933,718 6/1990 Furuya ..... 399/13
5,521,693 5/1996 Kojima et al. ..... 399/90 X
5,581,325 12/1996 Tsuda et al. ..... 399/90 X
5,845,173 12/1998 Zogg et al. ..... 399/90

*Primary Examiner*—William J. Royer
*Attorney, Agent, or Firm*—Loeb & Loeb, LLP

[57] ABSTRACT

An image recording device for forming a toner image on a photosensitive drum using an electrophotographic technique. The image recording device includes opposed metallic frames each having a notch for receiving and supporting an end of a metallic shaft of the photosensitive drum so that the photosensitive drum is supported between the metallic frames. A plate spring is located in the vicinity of one of the metallic frames such that the plate spring is forced to contact the photosensitive drum shaft when the photosensitive drum is supported between the metallic frames. The metallic frames have a fixed relation relative to a main frame of the image recording device. A power source is connected to the plate spring and the associated metallic frame is earthed. Thus, a current flows from the power source to the plate spring, the drum shaft and the associated metallic frame in turn when the photosensitive drum is supported on the metallic frames. This current is detected to determine whether the photosensitive drum unit has been in a desired position.

21 Claims, 4 Drawing Sheets

ELECTROPHOTOGRAPHIC IMAGE RECORDING APPARATUS WITH DETECTION OF PROPER INSTALLATION OF PHOTOSENSITIVE DRUM

BACKGROUND OF THE INVENTION

1. Technical Field

The present invention relates to an electrophotographic image recording apparatus and more particularly to such an image recording apparatus which can easily determine whether a drum unit is appropriately mounted at a predetermined position in a main body of the image recording apparatus.

2. Background Art

A conventional electrophotographic image recording apparatus includes a process unit which is comprised of a photosensitive drum, an electric charger , a developing unit and other components. Generally, the process unit is removably mounted in a main body of the image recording apparatus. If the process unit is designed to be able to make 10,000 copies, an associated counter is used to determine whether longevity of the process unit expires: it provides a user with information about the remaining life of the process unit. For example, when the total copy number counted by the counter reaches a certain value, an associated display indicates a message or sign for exchange of the process unit. Therefore, the user is not required to pay attention to a life of each of the components of the process unit such as the photosensitive drum and the developing unit. Rather, the user only needs to replace the existing process unit with a new one when the display unit indicates an "Exchange Process Unit" message or sign.

Although the components of the process unit such as the photosensitive drum and the developing unit of the process unit are expendable components, their longevity are different from each other. Conventionally, when one of the components of the process unit reaches its life limit, the entire components of the process unit should be replaced since the components are integrated to a single process unit. In view of this drawback, there is a proposal which allows independent installation of the photosensitive drum and the developing unit. These two parts are separately mounted in the main body of the image recording apparatus and independently replaced with new ones according to their own life limits.

However, if the photosensitive drum unit and the developing unit are separately installed in the main body of the image recording apparatus, these two parts are respectively lifted up when jamming occurs in the main body of the image recording apparatus. This is troublesome. In addition, if the developing unit is first mounted on a main frame work of the image recording apparatus and then the photosensitive drum unit is mounted to the main frame work, appropriately positioning the photosensitive drum unit relative to the developing unit is difficult since there is no easy way to know if the relative positioning between the photosensitive drum unit, the developing unit and the apparatus main frame is pertinent. To deal with this problem conventionally, a projection is formed on a surface of a lateral wall of the photosensitive drum unit and a photoelectric sensor is provided to detect whether the projection is in place or not. If the photoelectric sensor determines that the projection is in a predetermined position, then the photosensitive drum unit is assumed to be appropriately mounted on the main frame of the image recording apparatus. However, this arrangement increases the number of the parts and raises a manufacturing cost. The photoelectric sensor is an expensive part.

In general, the photosensitive drum of the image recording apparatus has a surface formed of two layers: an outer photoconductive layer and an inner conductive layer. When the photosensitive drum is installed in the main body of the image recording apparatus, the inner conductive layer should always be grounded via a metallic portion (e.g., metallic frame) of the main frame of the image recording apparatus. Grounding is, for instance, established by contact between a shaft extending from the photosensitive drum and a hub-like portion of the metallic frame for receiving the drum shaft. A user removes the drum unit from the apparatus frame when paper jamming occurs or a life of the drum unit is assumed to have expired. However, if the drum shaft is not perfectly received in the hub-like portion of the apparatus frame when the drum unit is placed in an original position again after eliminating jamming or a new drum unit is installed in place of the old drum unit, the grounding becomes insufficient so that a desired electrostatic latent image is not created.

One example of conventional arrangements is disclosed in Japanese Patent Application, Laid-Open Publication No. 6-83251.

SUMMARY OF THE INVENTION

The present invention intends to solve the problems of the conventional image recording apparatus which particularly concern grounding of the photosensitive drum and detection of appropriate installation of the photosensitive drum.

According to one aspect of the present invention, there is provided an image recording apparatus for forming a toner image on a photosensitive drum using an electrophotographic technique comprising opposed metallic frames each having a support portion for supporting an end of a metallic shaft of the photosensitive drum (the photosensitive drum extends between the opposed metallic frames when mounted), and a plate spring member located in the vicinity of one of the metallic frames such that the plate spring member is forced to contact the photosensitive drum shaft when the photosensitive drum is mounted on the metallic frames. The metallic frames have a fixed positional relation relative to a main frame of the image recording apparatus. A power source is connected to the plate spring member and the associated metallic frame is earthed. Thus, a current flows from the power source to the plate spring member, the drum shaft and the associated metallic frame in turn when the photosensitive drum is supported on the metallic frames. This current is detected to determine whether the photosensitive drum unit has been in a desired position. A common inexpensive current sensor or the like is only required and an expensive device such as a photoelectric sensor is not necessary to know if the photosensitive drum is appropriately mounted relative to the main frame of the image recording apparatus. If no current is detected, it means that the drum shaft ends are not supported by the support portions of the metallic frames. In such a case, the apparatus does not start image formation.

Each of the support portions of the metallic frames may have a U-shaped groove for firmly receiving the associated end of the photosensitive drum shaft. A width of the groove may substantially be equal to a diameter of the drum shaft. When the ends of the photosensitive drum shaft are received in the grooves, positional relationship between the photosensitive drum and the metallic frames (or the main frame of the apparatus) is fixed. Earthing of the photosensitive drum is achieved by contact between the metallic frame and the drum shaft, and a current passage is also established by contact between the metallic frame and the drum shaft.

The main frame work of the image recording apparatus may be molded from an insulating resin material and the plate spring may be made from a conductive and metallic plate. The plate spring may have an angled portion exposed to an interior of the main frame. Upon mounting the photosensitive drum on the metallic frames, the plate spring resiliently contacts the drum shaft and a current is caused to flow from a power source to the ground through the drum shaft and the metallic frame. Since the current passage is established in this manner, the number of parts needed to constitute the image recording apparatus or a means for determining whether the photosensitive drum is appropriately mounted on the frame of the apparatus is small.

BRIEF DESCRIPTION OF THE ACCOMPANYING DRAWINGS

DETAILED DESCRIPTION OF THE PREFERRED EMBODIMENTS

Now, a preferred embodiment of the present invention will be described with reference to the accompanying drawings. An image recording apparatus according to the present invention may be embodied as a printer or facsimile machine employing an electrophotographic technique or a small copier. Like common image recording apparatuses, a recording paper is fed to the image recording apparatus of the invention from a paper cassette, and a toner image is formed on a photosensitive drum. The toner image is then transferred to the recording paper by a transfer unit and fixed by a fixer. After fixing, the recording paper is discharged to an outlet tray from the image recording apparatus.

Figure 1:
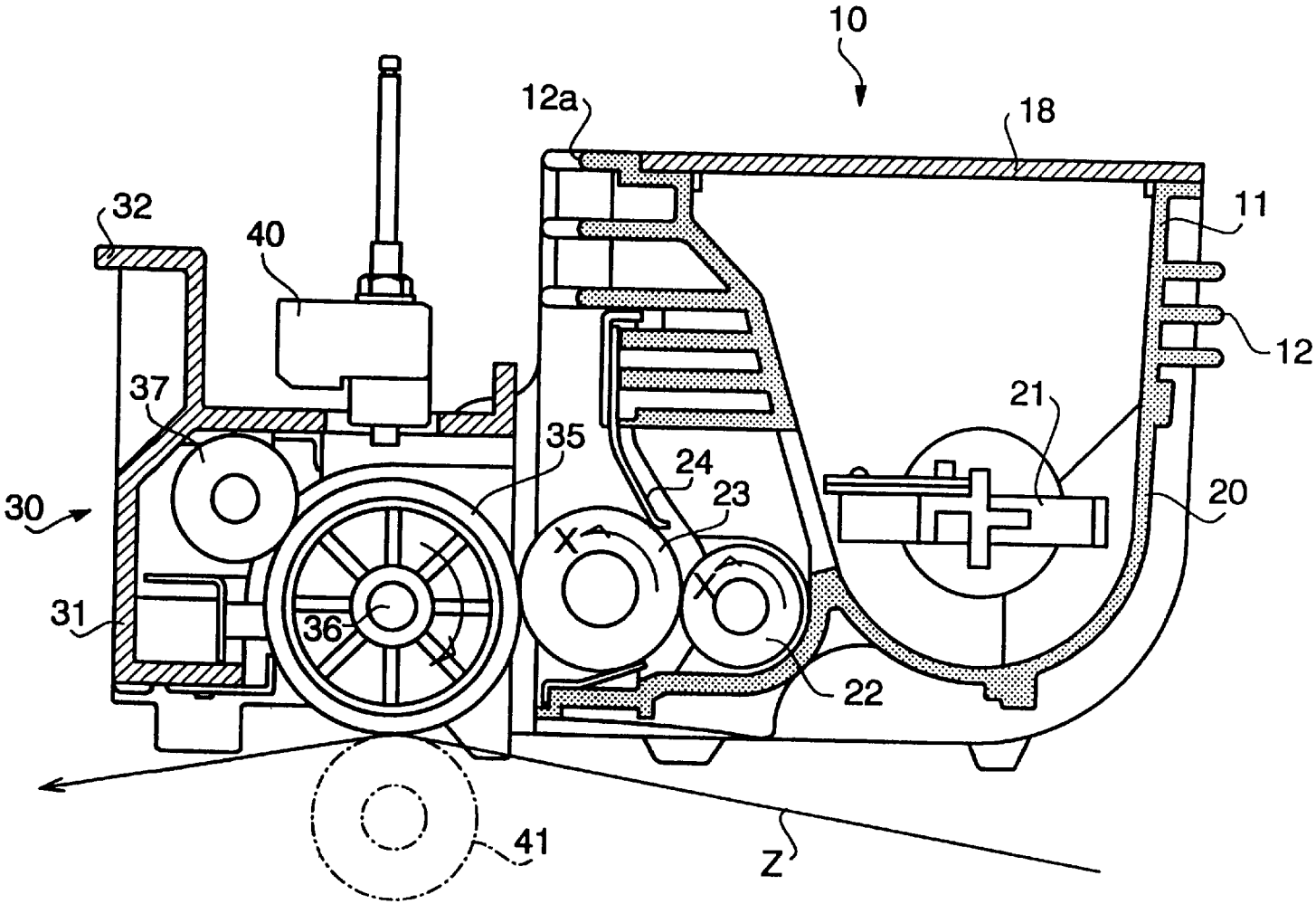
FIG. 1 illustrates a sectional view of various components of an image recording apparatus according to the present invention which are particularly utilized for image formation.

Referring to FIG. 1, illustrated are components for forming a toner image and transferring it onto a recording paper. The recording paper is transferred as indicated by the arrow Z. These components are collectively referred to as an image forming part in this particular specification. The image formation part includes a photosensitive drum unit 30, a developing unit 10 and a write unit 40. The photosensitive drum unit 30 includes a photosensitive drum 35 opposed to a transfer roller 41. The photosensitive drum unit 30 and the developing unit 10 are separate units and removably mounted on a main frame 1 (FIG. 6) of the image recording apparatus. FIG. 1 illustrates the photosensitive drum unit 30 and the developing unit 10 after installed on the apparatus main frame. In the illustrated embodiment, the photosensitive drum unit 30 is supported by a pair of support plates 15 (FIG. 4; will be described) of the developing unit 10 and then the developing unit 10 and the photosensitive drum unit 30 are mounted on the main frame together. It should be noted that the developing unit 10 may first be mounted on the main frame and the photosensitive drum unit 30 may then be mounted on the developing unit 10.

In this embodiment, the developing unit 10 includes a toner container 20 for storing non-magnetic toner, an upper frame 11 integral to the toner container 20, a toner stirrer 21 located in the toner container 20 for stirring toner and feeding the toner to an outlet of the container 20, a feed roller 22 located at the outlet of the toner container 20, a developing roller 23 in contact with the feed roller 22 on the upstream side and with the photosensitive drum 35 on the downstream side, and a regulation member 24 in contact with the developing roller 23. The toner contains substantially one component. The upper frame 11 has a plurality of parallel ribs 12 and 12*a* on its lateral surface and along an upper opening periphery. A lid 18 is placed over the upper frame 11. The ribs 12 and 12*a* serve as handle portions when lifting the developing unit 10. In addition, the ribs 12 and 12*a* reinforce the upper frame 11 and the toner container 20 and improves easiness of handling of the toner container 20. The stirrer 21 may include a rotating shaft and a plurality of blades radiantly extending from the rotating shaft. The feed roller 22 may be an elastic roller which includes a rotating shaft and a sponge-like conductive and elastic body attached to the shaft or conductive fibers (or hairs) extending from the shaft. A predetermined bias voltage (e.g., −600V to −700V and preferably about −650V) is applied to the shaft of the feed roller 22 from a power source (not shown).

The developing roller 23 includes a metallic roller shaft (e.g., stainless steel shaft) and a conductive rubber (e.g., silicon rubber, urethane rubber, NBR) of predetermined thickness attached over the shaft. The developing roller 23 has a smooth surface as a whole. A bias voltage of −300V to −400V (preferably about −350V) is applied to the developing roller 23. The toner thickness regulating member 24 is provided for making the toner over the developing roller 23 have a uniform thickness. The toner thickness regulation member 24 is a conductive urethane resin sheet or stainless steel plate which has a certain spring property. A bias voltage of −600V to −700V (preferably about −650V) is applied to the toner thickness regulation member 24.

A distance between the axis of the toner feed roller 22 and that of the developing roller 23 is slightly smaller than the sum of a radius of the toner feed roller 22 and that of the developing roller 23. These rollers 22 and 23 are both caused to rotate counterclockwise as indicated by the two arrows X respectively so that the rollers 22 and 23 are slid relative to each other in opposite directions while pressed against each other at a contact area between the rollers. Because of a friction effect between the rollers 22 and 23 and a difference between the bias voltages applied to the rollers 22 and 23, the toner between the rollers 22 and 23 is electrically charged and caused to adhere on the surface of the developing roller 23. The toner on the developing roller surface is adjusted to a uniform thickness by the regulation member 24. Then, the toner is exposed to the photosensitive drum 35 and transferred over the electrostatic latent image formed on the photosensitive drum 35 so as to create a toner image on the photosensitive drum 35.

The photosensitive drum unit 30 includes the photosensitive drum 35 and a brush roller-like charger 37. A number of fibers or hairs extend from the surface of the charger 37. The write unit 40 is placed above the photosensitive drum 35 to write an image. The toner image formed on the photosensitive drum 35 is transferred to a recording paper upon electric discharge from the transfer roller 41. The write unit 40 includes an LED head array and LEDs are caused to emit a beam of light toward the photosensitive drum 35 according to information from an image information outputting device (not shown).

The photosensitive drum 35 has a grounded photoconductive surface and a shaft 36. Grounding is achieved via the drum shaft 36 and a pair of frames 2 (FIG. 6) supporting the drum shaft 36 (will be descried) in this embodiment. The frames 2 have a fixed positional relation relative to the main frame of the image recording apparatus. The electric charger 37 charges the photosensitive drum 35 to −750V. That portion of the photosensitive drum 35 which is illuminated by the write unit 40, which corresponds to black of the image information, has a voltage of about −50V. As a result, a voltage difference is created between the illuminated portion and non-illuminated portion and an electrostatic latent image is formed according to the image information. The non-illuminated portion corresponds to white of the image information.

As the toner charged to about −650V on the developing roller 23 contacts the electrostatic latent image on the photosensitive drum 35, it is attracted by the illuminated portions of the photosensitive drum surface so that a toner image is formed on the photosensitive drum surface (reversing). The recording paper is fed between the photosensitive drum 35 and the transfer roller 41. At the toner image transfer position, a bias voltage of 500V to 2 kV is applied to a back face of the recording paper from the transfer roller 41 so that the toner image is transferred onto the recording paper from the photosensitive drum 35. After toner image transfer, the recording paper Is sent to a fixing unit upon rotation of the photosensitive drum 35. In the fixing unit, heating and pressing are applied to the image on the recording paper, and the recording paper is eventually discharged from the image recording apparatus as a copy.

The photosensitive drum unit 30 also has a unit frame 31 made from a plastic material. A handle portion 32 extends horizontally from an upper end of the unit frame 31 for easier loading/unloading of the photosensitive drum unit 30.

Figure 2:
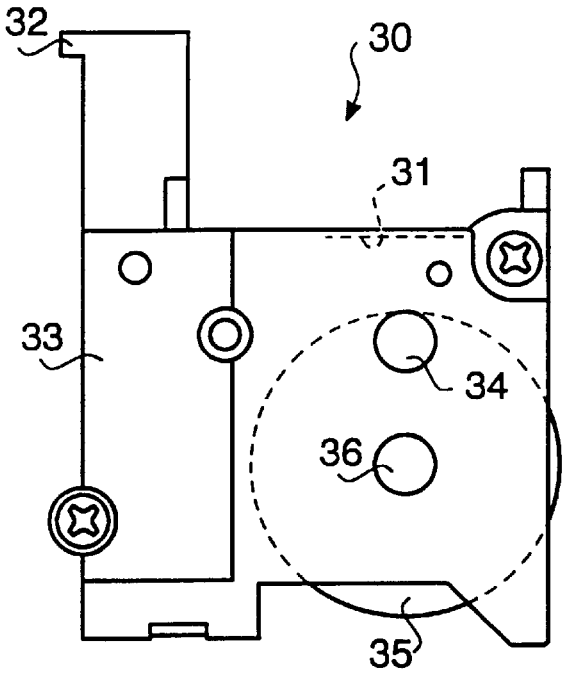
FIG. 2 illustrates a lateral view of a photosensitive drum unit shown in FIG. 1.
Figure 3:
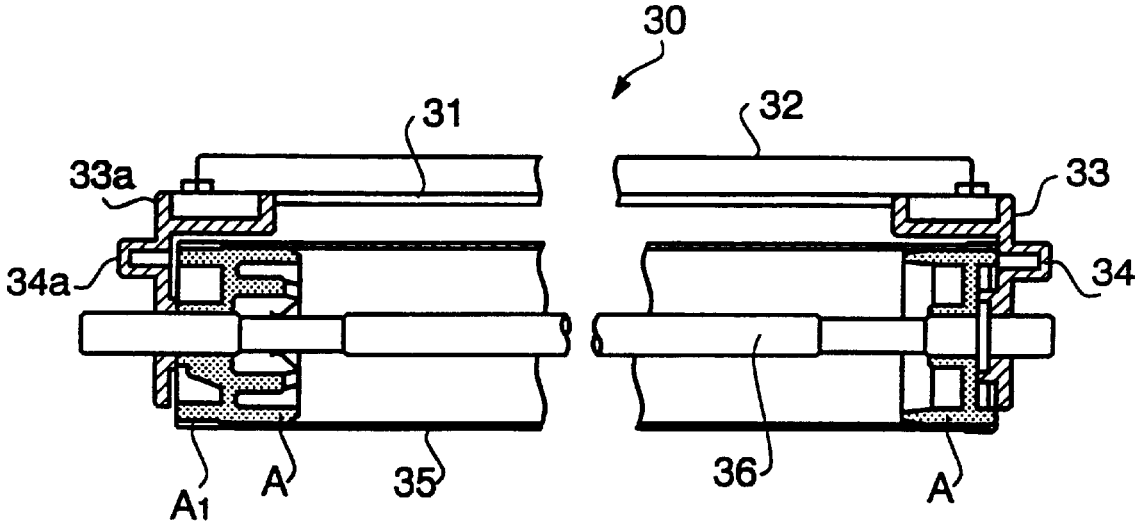
FIG. 3 illustrates a front sectional view of the photosensitive drum unit.

FIGS. 2 and 3 depict the construction of the photosensitive drum unit 30 in detail. FIG. 2 illustrates the right side view and FIG. 3 illustrates the front view in cross section. Referring to FIG. 3, the photosensitive drum unit 30 has the unit frame 31 and lateral frames 33 and 33*a*. The metallic drum shaft 36 is horizontally supported by bearings A provided at longitudinal ends of the photosensitive drum 35 such that ends of the shaft 36 project outward from the lateral frames 33 and 33*a*. The bearings A are fixed to the drum 35. Pins 34 and 34*a* also project horizontally outward from the lateral frames 33 and 33*a* above the ends of the shaft 36. The pins 34 and 34*a* are parallel to the photosensitive drum shaft 36. The pins 34 and 34*a* are positioned above the ends of the photosensitive drum shaft 36 as understood from FIG. 2. The pins 34 and 34*a* constitute a means for positioning the photosensitive drum unit 30 relative to the developing unit 10 and the image recording apparatus. The left bearing A has a gear A1 which meshes with a drive gear (not shown) via a suitable intermediate mechanism such as a belt and causes the photosensitive drum 35 to rotate about its axis.

Figure 4:
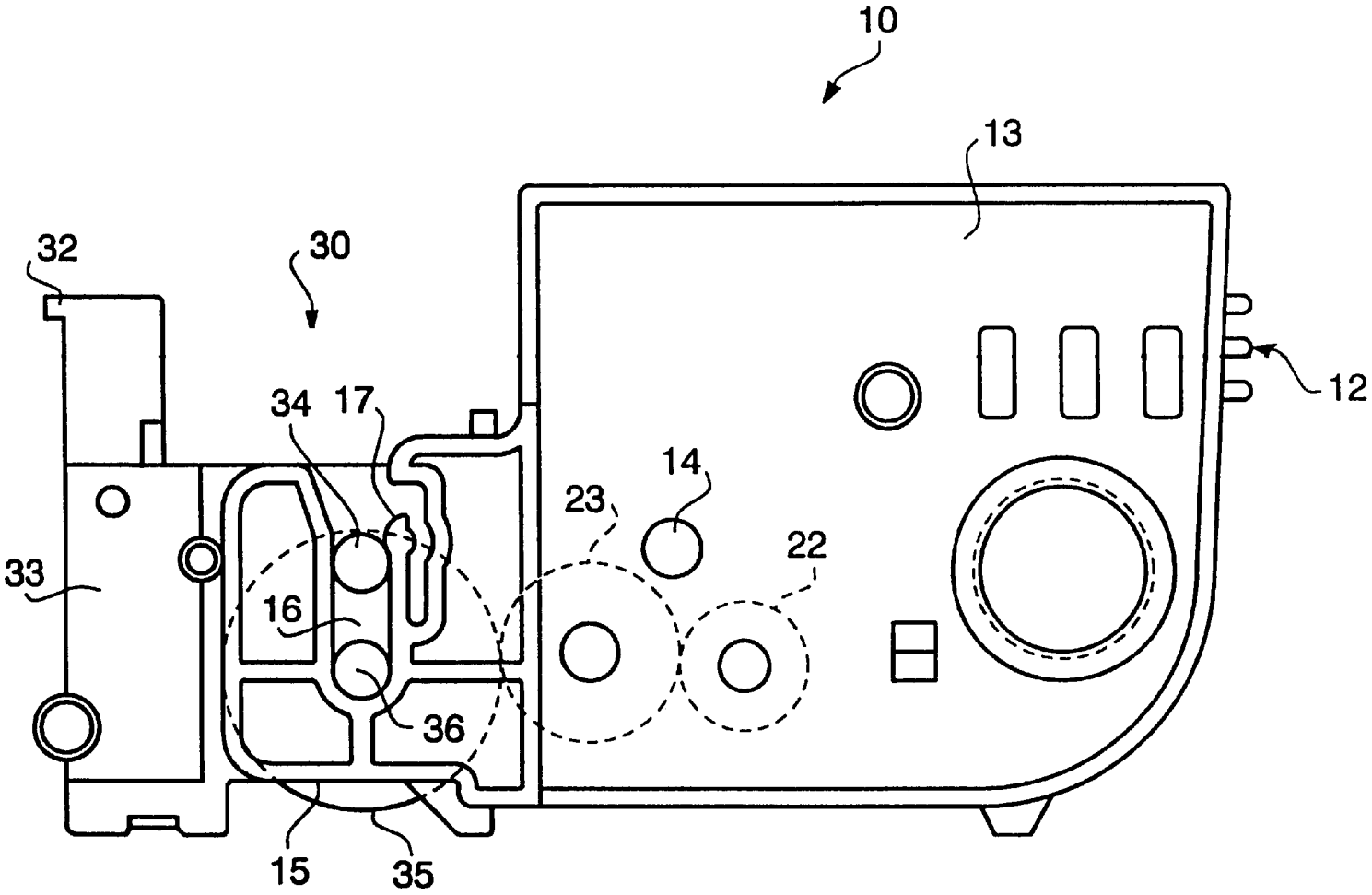
FIG. 4 illustrates a developing unit and the photosensitive drum unit as combined.
Figure 5:
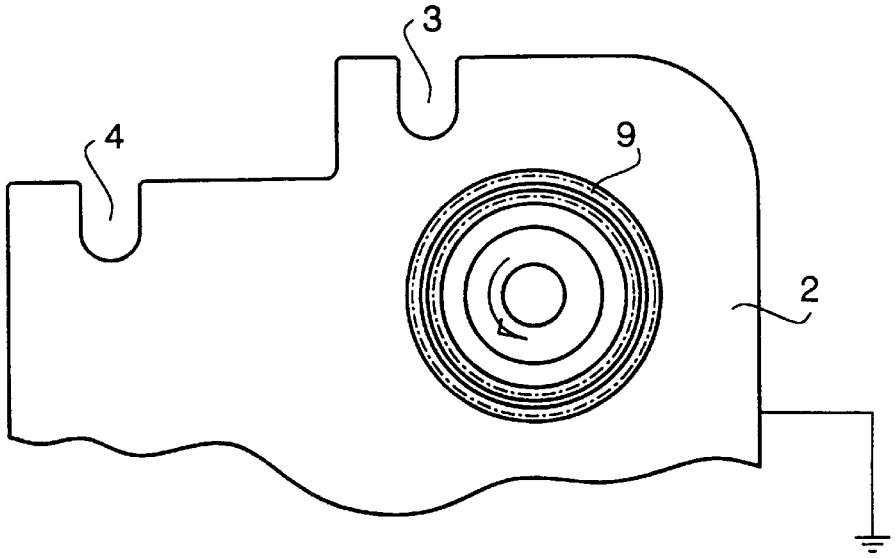
FIG. 5 illustrates an additional frame member provided along a main frame of the image recording apparatus.

Referring now to FIG. 4, illustrated are the developing unit 10 and the photosensitive drum unit 30 joined with each other before mounted on the image recording apparatus. As mentioned above, these units 10 and 30 are first joined with each other and mounted on the image recording apparatus simultaneously. A gear (not shown) is mounted on the shaft of the feed roller 22 and another gear (not shown) is mounted on the shaft of the developing roller 23, and a drive power is transmitted to these gears of the shafts of the rollers 22 and 23 from a drive gear 9 (FIG. 5). The developing unit 10 has a main casing 13 and a pair of support plates 15 extending generally horizontally from the main casing 13 (only one support plate 15 Is illustrated in the drawing). The support plates 15 are spaced in a direction perpendicular to the drawing sheet such that the photosensitive drum 35 is supported between the support plates 15. Each support plate 15 has a vertically elongated U-shaped groove or notch 16. When the photosensitive drum unit 30 is mounted on the developing unit 10, the ends of the shaft 36 and the pins 34 and 34*a* all projecting in the longitudinal direction of the photosensitive drum 35 are received in the vertically elongated U-shaped grooves 16 of the support plates 15. The developing unit 10 has pins 14 on its lateral walls of the main casing 13, respectively. FIG. 4 illustrates the right side view so that only one of the U-shaped grooves 16 is shown and only one of the pins 14 is shown. Each of the U-shaped grooves 16 has a resilient hook portion 17 at its upper opening. Spring forces applied to the pins 34 and 34*a* by the hook portions 17 hold the pins 34 and 34*a* in place respectively. Accordingly, relationship between the developing roller 23 and the photosensitive drum 35 is appropriately determined and fixed. The developing unit 10 and the photosensitive drum unit 30 are lifted up together when the plurality of parallel ribs or handle portions 12 and 12*a* (FIG. 1) are grasped and moved up by a user. Thus, the photosensitive drum unit 30 and the developing unit 10 are removable from the image recording apparatus simultaneously. Accordingly, if paper jamming occurs in a recording paper passage inside the image recording apparatus, these units 10 and 30 are unloaded at the same time from the image recording apparatus, and they are reloaded together into the image recording apparatus after eliminating the jamming.

The image recording apparatus has an arrangement for positioning the developing unit 10 and the photosensitive drum unit 30 in the image recording apparatus as illustrated in FIG. 5. Specifically, a pair of conductive metallic frames 2 are additionally provided on opposed inner side walls of the image recording apparatus. Each of the frames 2 is grounded and has a first U-shaped notch 3 for receiving the pin 14 (FIG. 4) of the developing unit 10 and a second U-shaped notch 4 for receiving the shaft end of the photosensitive drum 35. A drive gear 9 is mounted on the frame 2 to transmit the drive power to the rollers 22 and 23 of the developing unit 10. When installing the developing unit 10 and the photosensitive drum unit 30 in the image recording apparatus, the pins 14 of the developing unit 10 are received in the associated notches 3 and the ends of the drum shaft 36 of the photosensitive drum unit 30 are received in the associated notches 4.

In this particular embodiment, the photosensitive drum unit 30 is mounted on the support plates 15 of the developing unit 10 and then these units are mounted on the main body of the image recording apparatus.

Figure 6:
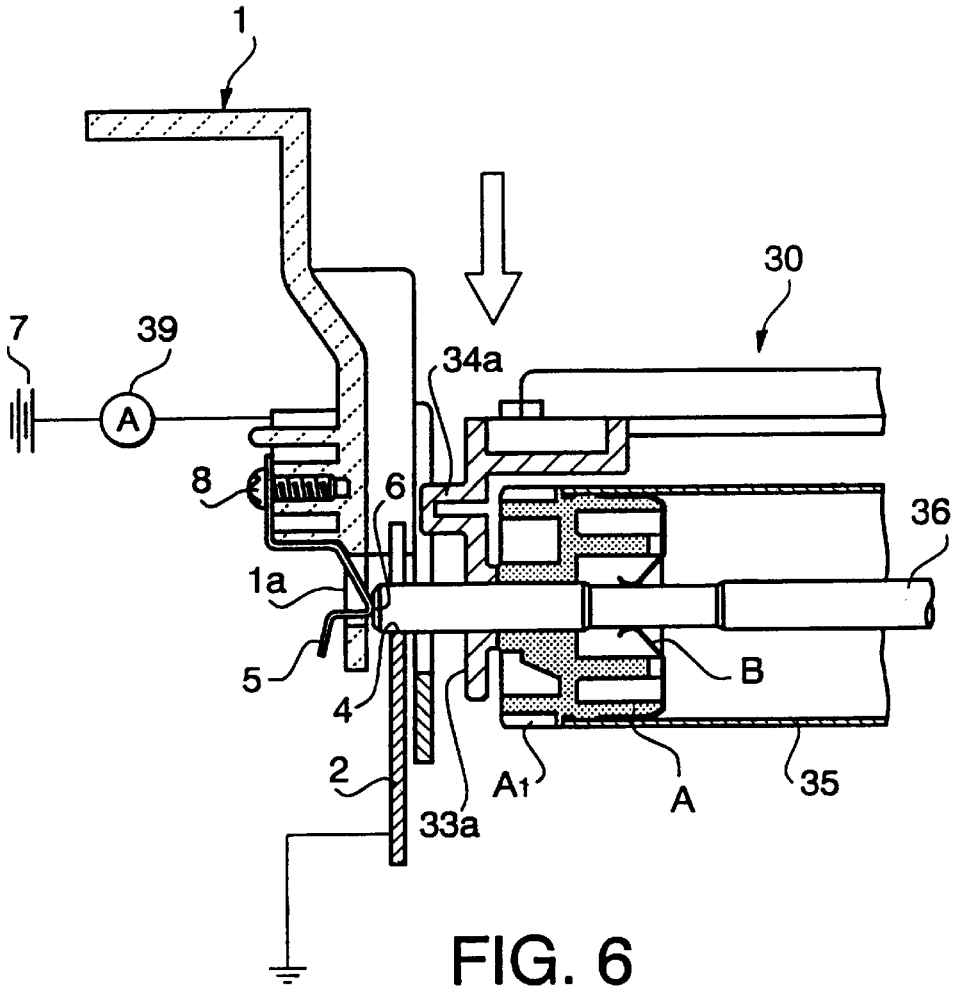
FIG. 6 is a sectional view of a detection mechanism according to the present invention.

As understood from FIG. 6, the frames 2 vertically extend along the opposed inner walls of a main frame 1 of the image recording apparatus (only one frame 2 Is illustrated in the drawing). The frame 2 is made from a conductive plate. A plate spring 5 is attached to each side of the main frame 1 by a securing member 8 such as a screw. Each plate spring 5 has a generally J-shaped portion 6 which fits in an opening 1*a* of the main frame 1. Each of the plate springs 5 is made from a resilient, conductive and metallic plate such as phosphor bronze. A power source 7 and an ammeter (i.e., current detector) 39 are connected in series to each of the plate springs 5. It should be noted that a free end (lower end) of the plate spring member 5 seats on an outer periphery of the opening 1*a* and the rightmost end of the J-shaped portion 6 projects inside the main frame 1 but does not contact the frame 2 when the photosensitive drum unit 30 is not mounted on the frame as indicated by the broken line. The openings 1*a* are formed to generally face the notches 4 of the frames 2. When the drum shaft 36 is appropriately received in the notches 4 of the frames 2, the J-shaped portion 6 of each plate spring 5 abuts one of the ends of the drum shaft 36 so that a current is allowed to flow from the power source 7 to the grounded metallic frame 2 through the plate spring 5 and the drum shaft 36. This current is detected by the detector 39.

In the arrangement shown in FIG. 6, the photosensitive drum 35 has an outer surface layer made from a photoconductive layer and an inner layer made from an electrically conductive layer (e.g., aluminum). The photosensitive drum 35 also has the insulated bearing portions at its ends. A conductive terminal element B is attached to at least one of the bearing A in such a manner that one end of the element B slidably contacts the surface of the drum shaft 36 and the other end is clamped between the inner surface of the photosensitive drum 35 and the associated bearing A.

Therefore, when the photosensitive drum 35 is mounted on the frames 2, the inner surface of the drum 35 is grounded via the terminal element B, the drum shaft 36 and the metallic frame 2. When optical information is written on the uniformly charged drum surface during image formation, the illuminated surface(s) of the photosensitive drum 35 become(s) conductive, and an electric charge on the illuminated area(s) is grounded from the drum inner surface whereby an electrostatic latent image is formed. In this invention, it is determined whether the photosensitive drum unit 30 is mounted In a desired position by detecting whether grounding of the photosensitive drum is established. This determination can be made easily by employing an ordinary inexpensive current sensor.

As described above, the two metallic frames 2 are attached to the main frame 1 for mounting the two units 10 and 30 relative to the main frame 1, and the frames 2 are earthed. The main frame 1 is made from a non-conductive material such as plastic and the plate springs 5 do not contact the photosensitive drum shaft 36 when the drum shaft 36 is not in a desired position. Therefore, no current flows from the source 7 toward the frames 2 when the drum shaft 36 is not in a desired position. When the photosensitive drum unit 30 is appropriately mounted on the developing unit 10 and then on the frames 2, the plate springs 5 contact the end faces of the drum shaft 36 and the current can flow from the plate springs 5 to the associated frames 2 via the photosensitive drum shaft 36. The current detector 39 may be provided at any suitable position between the power source 7 and the ground to detect a current which is allowed to flow from the associated power source 7 upon installation of the photosensitive drum unit 30 on the associated frame 2 of the apparatus. The downward unshaded arrow indicates the direction of mounting of the photosensitive drum unit 30.

It should be noted that the developing unit 10 may first be mounted on the metallic frames 2 and the photosensitive drum unit 10 may then be mounted on the metallic frames 2.

What is claimed is:

1. An image recording apparatus for forming a toner Image on a photosensitive drum using an electrophotographic technique, comprising:

a photosensitive drum having a shaft;

a metallic frame having a first support portion for supporting the shaft of the photosensitive drum, the metallic frame being grounded; and a plate spring spaced from the first support portion of the metallic frame, a voltage being applied to the plate spring, and the plate spring member being forced to contact the drum shaft when the photosensitive drum is mounted on the metallic frame, whereby the plate spring is electrically connected to the metallic frame via the drum shaft upon mounting the photosensitive drum on the metallic frame.

2. The image recording apparatus of claim 1, wherein the first support portion of the metallic frame has a U-shaped groove, and a width of the U-shaped groove is substantially equal to a diameter of the drum shaft for receipt of the drum shaft.

3. The image recording apparatus of claim 2, wherein the plate spring is made from a conductive and metallic plate material and is attached to a main frame of the image recording apparatus, the main frame is made by a molding process using an insulating resin material, and the plate spring has an angled portion exposed to an interior of the main frame.

4. The image recording apparatus of claim 3, further including determination means for determining whether the photosensitive drum is appropriately mounted on the metallic frame based on change of a current flowing through the plate spring, the current being caused to flow upon establishment of electrical connection between the plate spring and the metallic frame.

5. The image recording apparatus of claim 2, further including determination means for determining whether the photosensitive drum is appropriately mounted on the metallic frame based on change of a current flowing through the plate spring, the current being caused to flow upon establishment of electrical connection between the plate spring and the metallic frame.

6. The image recording apparatus of claim 1, wherein the plate spring is made from a conductive and metallic plate material and is attached to a main frame of the image recording apparatus, the main frame is made by a molding process using an insulating resin material, and the plate spring has an angled portion exposed to an interior of the main frame.

7. The image recording apparatus of claim 6, further including determination means for determining whether the photosensitive drum is appropriately mounted on the metallic frame based on change of a current flowing through the plate spring, the current being caused to flow upon establishment of electrical connection between the plate spring and the metallic frame.

8. The image recording apparatus of claim 1, further including determination means for determining whether the photosensitive drum is appropriately mounted on the metallic frame based on change of a current flowing through the plate spring, the current being caused to flow upon establishment of electrical connection between the plate spring and the metallic frame.

9. The image recording apparatus of claim 8, wherein the determination means is a current detector.

10. The image recording apparatus of claim 9 further including a controller for allowing the apparatus to form a toner image only when the current detector detects a current.

11. The image recording apparatus of claim 1, further including a developing unit having a second support portion on which the photosensitive drum is removably mounted, and wherein the photosensitive drum is first mounted on the developing unit and then the photosensitive drum is mounted on the metallic frame together with the developing unit.

12. The image recording apparatus of claim 11, wherein the developing unit has a shaft and the metallic frame has a third support portion for supporting the developing unit when the photosensitive drum is mounted on the metallic frame together with the developing unit.

13. The image recording apparatus of claim 12, wherein the developing unit has an outwardly extending pin and the third support portion has a second groove to receive the pin of the developing unit.

14. The image recording apparatus of claim 11, wherein the second support portion of the developing unit has a third vertically elongated U-shaped groove, the photosensitive drum has a second pin extending outwardly from an end face of the photosensitive drum and parallel to the shaft of the photosensitive drum, and a width of the second pin and a diameter of the photosensitive drum shaft are substantially equal to the width of the vertically elongated U-shaped groove so that both the photosensitive drum shaft and the second pin are received in the vertically elongated U-shaped groove when the photosensitive drum is mounted on the developing unit.

15. The image recording apparatus of claim 14, wherein a periphery of the vertically elongated U-shaped groove has a resilient element to slightly reduce an opening of the vertically elongated U-shaped groove so that the second pin is resiliently held by the resilient element when the photosensitive drum is mounted on the developing unit.

16. The image recording apparatus of claim 11, wherein the photosensitive drum and the developing unit are simultaneously removable from the main frame.

17. The image recording apparatus of claim 16, wherein the developing unit has at least one flange extending horizontally outward such that the flange can be used as a handle when a user lifts up the developing unit and the photosensitive drum for simultaneous removal from the metallic frame of the apparatus.

18. The image recording apparatus of claim 1, wherein the photosensitive drum is removable from the metallic frame.

19. The image recording apparatus of claim 1, wherein the shaft of the photosensitive drum is made from a metal.

20. An image recording apparatus comprising:

a main frame;

a photosensitive drum having a shaft;

first and second frames spaced from each other to support the photosensitive drum therebetween, the first and second frames having a fixed relationship relative to the main frame, the first frame being grounded; and a first member connected to a power source, the first member being caused to electrically connect to the shaft of the photosensitive drum and in turn to the first frame so that a current flows to the first frame from the power source through the first member and the shaft of the photosensitive drum when the photosensitive drum is supported between the first and second frames, with the first member being spaced from the shaft of the photosensitive drum when the photosensitive drum is not supported between the first and second frames.

21. The image recording apparatus of claim 20 further including a sensor for detecting a current flowing from the power source to the first frame.

* * * * *